US005215782A

United States Patent [19]

Yoshioka et al.

[11] Patent Number: 5,215,782

[45] Date of Patent: * Jun. 1, 1993

[54] METHOD OF FORMING FERRITE COATINGS

[75] Inventors: Katsuaki Yoshioka, Nerima; Masao Oishi, Neyagawa; Takao Saito, Toyonaka; Katsukiyo Ishikawa, Kuze, all of Japan

[73] Assignee: Nippon Paint Co, Ltd., Osaka, Japan

[ * ] Notice: The portion of the term of this patent subsequent to Mar. 27, 2007 has been disclaimed.

[21] Appl. No.: 498,133

[22] Filed: Mar. 23, 1990

[30] Foreign Application Priority Data

Feb. 14, 1990 [JP] Japan ..... 2-31504

[51] Int. Cl.[5] ..... B05D 5/12; B05D 7/04; B05D 3/10; B05D 1/18

[52] U.S. Cl. ..... 427/132; 427/217; 427/304; 427/443.1

[58] Field of Search ..... 427/132, 217, 304, 443.1

[56] References Cited

U.S. PATENT DOCUMENTS 4,113,658 9/1978 Geus ..... 252/454

4,837,046 6/1989 Oishi et al. ..... 427/443.1

4,911,957 3/1990 Oishi et al. ..... 427/443.1

FOREIGN PATENT DOCUMENTS 63-65085 3/1988 Japan .

OTHER PUBLICATIONS

Abstract of JP 65085 published Mar. 1988.

*Primary Examiner*—John F. Niebling
*Assistant Examiner*—Kishor Mayekar
*Attorney, Agent, or Firm*—Sughrue, Mion, Zinn, Macpeak & Seas

[57] ABSTRACT

There is disclosed a method for forming a ferrite coatings on a substrate, which comprises:

(a) bringing a substrate into contact with water or an aqueous solution, and (b) adding a ferrous ion solution, an oxidizer solution and a pH controller so that pH and an oxidation-reduction potential may be included within the range specified by A (6, −440 mV), B (6, −130 mV), C (11, −430 mV) and D (11, −740 mV) in a pH - oxidation-reduction potential graph.

12 Claims, 1 Drawing Sheet

FORMULA 5 : $E_0 = 0.728 - 0.173\ pH - 0.0591 \log(Fe^{2+})$

FORMULA 4 : $E_0 = 0.044 + 0.0295 \log(Fe^{2+})$

FORMULA 3 : $E_0 = 0.980 - 0.2364\ pH - 0.0886 \log(Fe^{2+})$

FORMULA 2 : $E_0 = 0.221 - 0.0591\ pH$

FORMULA 1 : $E_0 = -0.085 - 0.0591\ pH$ (a) : x = 0
(b) : x = −2
(c) : x = −4
(d) : x = −6
} $Fe^{2+}$ MOLAR CONCENTRATION : $10^X$

-- POURBAIX FORMULA --

FORMULA 5 : $E_o = 0.728 - 0.173\ pH - 0.0591 \log(Fe^{2+})$
FORMULA 4 : $E_o = 0.044 + 0.0295 \log(Fe^{2+})$
FORMULA 3 : $E_o = 0.980 - 0.2364\ pH - 0.0886 \log(Fe^{2+})$
FORMULA 2 : $E_o = 0.221 - 0.0591\ pH$
FORMULA 1 : $E_o = -0.085 - 0.0591\ pH$ (a) : $x = 0$
(b) : $x = -2$
(c) : $x = -4$
(d) : $x = -6$
} $Fe^{2+}$ MOLAR CONCENTRATION : $10^X$

-- POURBAIX FORMULA--

METHOD OF FORMING FERRITE COATINGS

FIELD OF THE INVENTION

The present invention relates to a method of forming a ferrite coating, particularly on a particulate or fibrous substrate.

BACKGROUND OF THE INVENTION

A method for forming a ferrite coating on a substrate has been known, for example, as disclosed in Japanese Provisional Patent Publication No. 65085/1988 in which an oxidizer solution and a ferrous ion solution are added to a deoxidized solution containing particulate and/or fibrous substrates to form a thin ferrite coating on the particulate and/or fibrous substrates. However, according to this method, by-products are liable to be formed and a stable and controlled magnetic film could be obtained with difficulty.

SUMMARY OF THE INVENTION

The present invention provides a method for forming a ferrite coating on a substrate, which comprises:

(a) bringing a substrate into contact with water or an aqueous solution, and (b) adding a ferrous ion solution, an oxidizer solution and a pH controller so that the pH and oxidation-reduction potential may be included within the range specified by A (6, −440 mV), B (6, −130 mV), C (11, −430 mV) and D (11, −740 mV) in the pH - oxidation-reduction potential graph.

DESCRIPTION OF THE PREFERRED EMBODIMENTS

Figure 1:
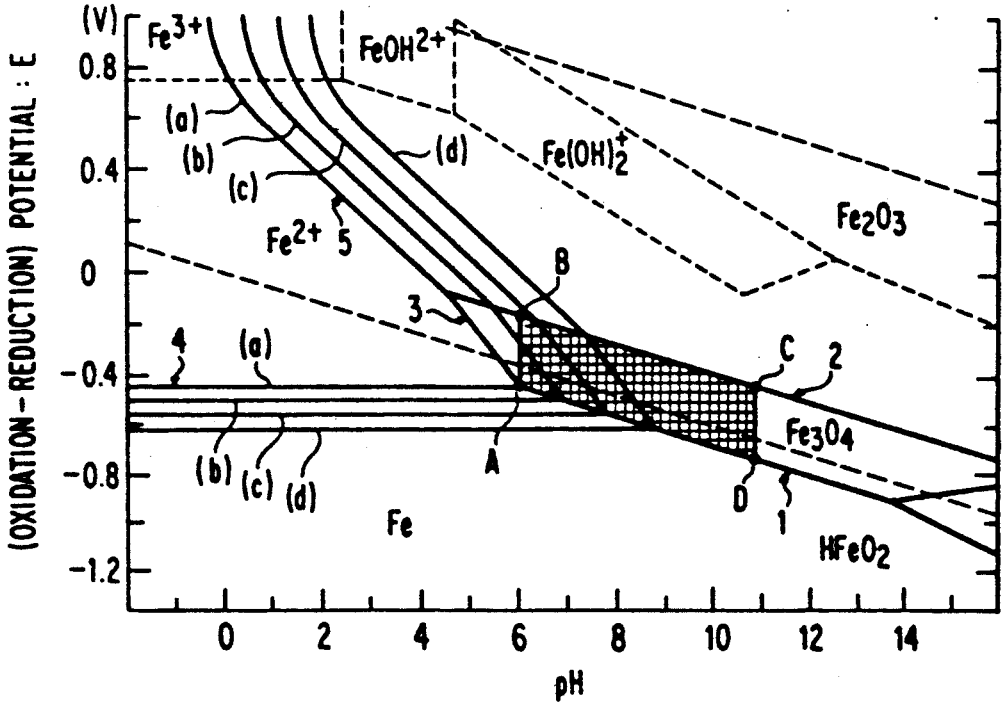
FIG. 1 is a pH-oxidation-reduction potential graph showing the range (net portion) in which the ferrite coatings obtained in the present invention can be obtained.

The substrate to be used in the present invention is not particularly limited, but may be preferably fine particulate and fibrous substrates. The present inventor has found it important how to control ferrous ions not adsorbed on a particulate and/or fibrous substrate surface in a solution at a level of a small amount, and accomplished an invention of obtaining a stable and controlled ferrite coating by controlling the pH and oxidation-reduction potential within a certain range.

Particularly, particulates with relatively greater particulate sizes (smaller specific surface area), for which speciality of surface energy of particulate can hardly be expected, have a low amount of ferrous ions adsorbed, and the amount of the ferrous ions in the solution has a great influence on the generation of by-products.

Further, in the present invention, it has been found that one can obtain a desired saturated magnetization amount by controlling the pH and oxidation-reduction potential within the range specified by A (6, −440 mV), B (6, −130 mV), C (11, −430 mV) and D (11, −740 mV).

Particulates may be preferably those having an average particle size of 100 μm or less. For those over 100 μm, formation of ferrite coatings becomes slow, whereby by-products are liable to be formed. In the present specification, particulates mean those shaped as spheres, amorphous shapes and plates. Also, selective formation of a ferrite coating may be conceivable on fibrous substrates, and in fact, such selective formation has been confirmed. Also, in the case of fibrous substrates, those with diameters of 100 μm may be preferably utilized.

Particulates or fibrous substrates (hereinafter called comprehensively as particulate substrates) may be formed from any kind of material. For example, they may be formed from such base materials as resins, metals, metal oxides, organic pigments, celluloses, ceramics, etc. Particularly, resins, metal oxides (including pigments, etc.), ceramics and organic pigments may be considered as preferred ones. In the case of fibrous substrates, natural fibers, synthetic fibers or inorganic fibers can be employed.

Formation of a ferrite coating is practiced in water or an aqueous solution in which particulate substrates are mixed. The aqueous solution in the present invention may be an aqueous solution of a pH buffering agent, for example, an organic acid salt such as ammonium acetate, preferably an aqueous solution in a deoxidized state. Ferrous ions are supplied into the aqueous solution in the form of salts such as hydrochlorides, sulfates, acetates, etc. The aqueous ferrous ion solution may also contain other metal ions together with ferrous ions. When the aqueous solution contains only ferrous ions as the metal ion, the coating is obtained as the spinel ferrite containing only ferrous ions, namely the film is of the magnetite $Fe_3O_4$. Also, in the aqueous solution, in addition to ferrous ions, there may be also contained other transition metal ions $M^{n+}$. Examples of other metal species may include zinc, cobalt, nickel, manganese, copper, vanadium, antimony, lithium, molybdenum, titanium, rubidium, magnesium, aluminum, silicon, chromium, tin, calcium, cadmium, indium, etc. When M is cobalt, cobalt ferrite ($CoxFe_{3x}O_4$) is obtained, while when it is nickel, nickel ferrite ($NixFe_{3x}O_4$) is obtained, and when M comprises plural kinds, a mixed crystal ferrite is obtained. These metal species other than ferrous ions are also supplied into the aqueous solution in the form of respective water-soluble salts.

In the present invention, as examples of oxidizers, nitrites, nitrates, hydrogen peroxide, organic peroxides, perchloric acid or dissolved oxygen water, etc., may be included. However, since those having high oxidizing power cause formation of by-products in the solution or lowering in purity of ferrite to occur, while those having low oxidizing power make the reaction of ferrite slower or result in no ferrite reaction at all, it is preferred to use a nitrite in the present invention. The pH of the aqueous solution is controlled to a pH of 6 to 11 by suitably selecting the kinds of anions and metal ions existing in the aqueous solution, but preferably is within the range from 6.5 to 10. For stabilization of pH, for example, a buffer such as ammonium acetate, sodium acetate, etc., or a salt having the buffering effect may be also added.

The oxidation-reduction potential is controlled between the line ① and the line ② in the pH - oxidation-reduction potential graph shown in FIG. 1. Therefore, by controlling the pH and oxidation-reduction potential within the portion specified by A, B, C and D shown in the pH - oxidation-reduction potential graph (FIG. 1), a desired ferrite coatings can be obtained.

In cases where the oxidation reduction potential is higher than the line BC, it is lower than the line AD and the pH is higher than the line CD, by-products are liable to be formed, formation of ferrite is insufficient and yet deviation of the saturated magnetization becomes remarkable. On the other hand, if the pH is lower than the line AB, deposition of ferrite coatings is low so that formation of coatings is difficult.

The temperature condition for implementing the reaction of the present invention may be within the range not higher than the boiling temperature of the aqueous solution, but preferably is within the range from 60° to 90° C. Also, the reaction may be carried out preferably under a deoxidized atmosphere. Under the condition where a large amount of oxygen exists, unnecessary an oxidation reaction will undesirably proceed. For example, it is preferred to carry out the reaction under a nitrogen atmosphere. Similarly, oxygen is also removed from the ferrous ion solution and the oxidizer solution to make a deoxidized aqueous solution.

The particulate substrates to be used in the present invention may be used as such, but may be also subjected to the pre-treatment practiced in a plate-shaped product such as magnetic disc, etc., such as plasma treatment, alkali treatment, acid treatment, physical treatment, etc. When these treatments are practiced, wettability with the aqueous solution can be improved to give a uniform film.

A preferred method of the present invention is to first suspend the particulate substrates in deoxidized water, and in this case, if necessary, affinity of the particulate substrates for water may be improved by deoxidizing with nitrogen gas or adding an additive such as a surfactant, etc. Next, if necessary, a pH buffering agent, etc., is mixed for control of pH to set pH to a desired value. Then, a ferrous ion solution and an oxidizer solution are added into the above suspension. During the addition process, oxidation-reduction potential and pH are controlled within constant ranges at predetermined values. Oxidation-reduction potential is controlled by varying the dropwise addition rate of the oxidizer solution or the ferrous ion solution. Control of pH is performed by adding suitably an alkali solution such as an ammonia solution, etc. Particularly preferably, pH and oxidation-reduction potential should be subject to fixed point control.

In this step, the ferrite coatings thickness can be extremely preferably controlled by the amount of metal ions added dropwise. The particulate substrates with ferrite coatings obtained are separated by filtration to give the desired product. The product may be also dried after separation, depending on the purpose.

In the present invention, the ferrous ion solution and the oxidizer solution are added into the suspension under control of oxidation-reduction potential with $Fe^{2+}/Fe^{3+}$.

For example, when the amount of the oxidizer solution added is made constant, if the amount of ferrous ion solution is made larger, the $Fe^{2+}$ concentration in the solution is enhanced, and the oxidation-reduction potential drops. In this case, the $Fe^{2+}$ concentration not adsorbed on the surfaces is enhanced, whereby by-products formed at other places than on particulate surfaces are increased. On the other hand, if the amount of $Fe^{2+}$ added dropwise is made smaller, there becomes substantially no $Fe^{2+}$ existing in the solution, whereby the oxidation-reduction potential is elevated to enhance the concentration of the oxidizer.

In this case, most of the $Fe^{2+}$ ions supplied and adsorbed are oxidized to $Fe^{3+}$, and no desired magnetization amount of ferrite can be obtained.

The oxidation-reduction potential in the solution in the present invention depends on pH, ferrite ion concentration, kind and concentration of oxidizer, but is also different depending on the temperature, kinds, concentrations of metal ions of other metal ions and deoxidized state, and therefore it is possible to obtain a desired saturated magnetization amount by suitably setting the control potential.

As the electrode for measuring oxidation-reduction potential, for the purpose of causing no unnecessary oxidation-reduction reaction to occur at the electrode, it is preferred to use an inert, electroconductive substance such as platinum, stainless steel, etc.

As described above, the steps of the present invention can effect coating of ferrite coatings on the surfaces of particulate substrates very selectively according to a simple method to give a coated product not found up to date having a desired saturated magnetization amount up to 92 emu/g, preferably in the range of about 1 to 60 emu/g.

In the present invention, it is possible to obtain a ferrite coated product having a controlled and desired saturation magnetization value depending upon various uses and objects. The ferrite coated product of the present invention can have various uses, for example, those having about 1 to 20 emu/g of a saturation magnetization amount can be employed as a pigment for a paint or an ink, those having about 20 to 30 can be used for a toner and those having about 30 to 60 can be used for medical use such as immunoassay or particulate selection.

The ferrite coated product of the present invention can be applied to various uses. For example, by applying ferrite coatings on a toner or carrier for electrophotography, prevention. of scattering of toner and use of a resin material with a lower softening point is rendered possible. Also, applications of the particulates coated with ferrite coatings to a display material (e.g., magnetic display), a recording material (magnetography), etc., are also conceivable. Also, the ferrite coatings can also be mixed into coating materials, inks, resin moldings, etc. Further, applications in the medical field are also possible, and a particulate medicament can be coated with ferrite and the coated product induced with a magnet into the diseased portion of a patient, thereby exhibiting an excellent pharmaceutical effect.

EXAMPLES

The present invention is described more specifically by referring to the preferred examples, which, however, are not to be construed as limiting the scope of the invention to their details.

Example 1

0.9 liter of deionized water was poured into a reactor vessel. sel.

One hundred (100) grams of deionized water having 10 g of titanium dioxide (reagent, manufactured by Wako Pure Chemical Industries, LTD.) dispersed therein was added to the reactor vessel, and oxygen in the solution was removed with $N_2$ gas. After thorough deoxidization, the pH value was adjusted to 6.9 with aqueous ammonia. The temperature in the reactor vessel was maintained at 70° C. A solution prepared by dissolving 20 g of sodium nitrite in one liter of deionized water which had been deoxidized and a ferrous ion solution of 100 ml prepared by adding 10 g of $FeCl_2$ into deoxidized water were added dropwise to the reactor vessel at a rate of 5 ml/min. By separate determining, the oxidation-reduction potential of this solution was set to −470 mV and the addition amount of the ferrous ion solution was controlled by addition rate. The pH value was maintained constant during this course. After approx. 20 minutes had passed, particulates of titanium oxide were encapsulated with magnetite. Virtually no magnetite particulates as by-products were formed. After 10 minutes of aging, the particulates were separated by filtration and rinsed with water. The color of the produced magnetite plated titanium oxide was gray.

According to the method, a product with yellowish color can be obtained by adding metal ions other than of iron, such as Zn or Ni. This type of product is applicable to various purposes such as paints or cosmetics.

Example 2

0.9 liter of deionized water was poured into a reactor vessel. sel.

One hundred (100) g of deionized water where 10 g of 6 μm polystyrene particulates (Fine Pearl 300F, manufactured by Sumitomo Chemical Co., Ltd.) dispersed therein was supplied to the reactor vessel, and oxygen in the solution was removed with $N_2$ gas. After thorough deoxidization, the pH value was adjusted to 6.9 by 0.1N—NaOH. Then, the reactor vessel was heated to 70° C., and the ferrous ion solution as prepared in Example 1 and a solution prepared by dissolving 20 g of sodium nitrite in one liter of deionized water already deoxidized was supplied to the reactor vessel at a rate of 5 ml/min. The pH value was maintained constant during this course and the oxidation-reduction potential was also maintained −470 mV as in Example 1. After approx. 20 minutes had passed, polystyrene particulates were encapsulated with magnetite. Virtually no magnetite particulates as by-products were formed. The magnetite plated polystyrene particulates were filtered out and rinsed with water. The color of obtained magnetite capsuled polystyrene particulates was black.

Example 3

0.9 liter of deionized water was poured into a reactor vessel.

One hundred (100) g of deionized water having 10 g of 6 μm polystyrene particulates (Fine Pearl 300F, manufactured by Sumitomo Chemical Co., Ltd.) dispersed therein was supplied to the reactor vessel, and oxygen in the solution was removed with $N_2$ gas. After thorough deoxidization, the pH value was adjusted to 6.9 by aqueous ammonia. Then, the reactor vessel was heated to 70° C., and a 100 ml ferrous ion solution containing 10 g of $FeCl_2$, 2 g of $NiCl_2$ and deionized water and a solution prepared by dissolving 20 g of sodium nitrite in one liter of deionized water already deoxidized were supplied to the reactor vessel at a rate of 5 ml/min. The pH value was maintained constant during this course. The oxidation-reduction potential was also maintained −470 mV as generally described in Example 1 and $NiCl_2$ did not affect the oxidation-reduction potential. After approx. 20 minutes had passed, polystyrene particulates encapsulated with Ni-ferrite were formed. Virtually no Ni-ferrite particulates as by-products were formed. The Ni-ferrite plated polystyrene particulates were filtered out and rinsed with water. The color of the obtained Ni-ferrite encapsulated polystyrene particulates was brown.

By selecting various resinous materials for seed particulates, the products obtained in Examples 2 and 3 may be applied to various fields such as magnetic toners, magnetic displays, cosmetics, powder paints, charge-preventive fillers, magnetic printing materials and the like.

Example 4

0.9 liter of deionized water was poured into a reactor vessel. sel.

One hundred (100) g of deionized water 30 g of glass cut fibers (manufactured by Fuji Fiber Glass Co., diameter, 15 μm; length, 3 mm) dispersed therein was supplied to the reactor vessel, and oxygen in the solution was removed with $N_2$ gas. After thorough deoxidization, the pH value was adjusted to 6.9 by aqueous ammonia. Then, the reactor vessel was heated to 70° C., and the ferrous ion solution as prepared in Example 1 and a solution prepared by dissolving 20 g of sodium nitrite in one liter of deionized water already deoxidized were supplied to the reactor vessel at a rate of 5 ml/min. The pH value was maintained constant during this course. The oxidation-reduction potential was also maintained at about −470 mV. After approx. 20 minutes had passed, glass fibers coated with magnetite were formed. Virtually no magnetite particles as by-products were formed. The magnetite plated glass fibers were filtered out and rinsed with water. The color of the obtained magnetite plated glass fibers was silver gray.

The magnetite plated glass fiber can be widely used for various purposes such as for charge-preventive fillers or improvement of dispersibility of glass fibers.

Further, examples controlled in saturated magnetization amount are described.

Example 5

Into a reactor vessel was charged 0.9 liter of deionized water. Into the water was thrown 100 g of deionized water having 10 g of polystyrene particulates (the same as in Example 2) with a particulate size of 6 μm previously dispersed therein, and deoxidization was performed with $N_2$ gas. After deoxidization was thoroughly performed, pH was adjusted to 8.0 with aqueous ammonia. The temperature within the vessel was maintained at 70° C. during that period. Into this, a solution of ferrous ions of 30% by weight prepared by dissolving previously $FeCl_2$ in deoxidized deionized water was supplied at a rate of 10 ml/min., and, further, a 15% by weight solution of sodium nitrite dissolved in deoxidized deionized water was supplied at a rate of 1 ml/min. During this period, pH was maintained constant. Also, the ferrous ion solution was supplied so that the controlled oxidation-reduction potential in the solution was maintained constantly at a value of −480 mV.

After 30 minutes, ferrite was formed on the polystyrene particulates. Substantially no by-produced ferrite particulate was formed. After aging for about 10 minutes, the particulates were separated by filtration and rinsed with water. According to this method, samples were prepared 5 times, and the particulates prepared were subjected to measurement of saturated magnetization amount at 10K Oersted by use of a VSM vibration system magnetic measuring device. As the result, saturated magnetization amounts of 31, 28, 26, 30 and 27 emu/g were obtained, and these particulates had an average value of 28.4 emu/g, with little deviation.

Example 6

Example 5 was repeated except that the oxidation-reduction potential in Example 5 was changed to −300 mV.

The results obtained are as shown below.

| Sample | |
|---|---|
| 1 | 25 emu/g |
| 2 | 22 |
| 3 | 23 emu/g |
| 4 | 18 |
| 5 | 20 |
| (average value | 21.6) |

Example 7

Example 5 was repeated except that the pH and the oxidation-reduction potential in Example 5 were changed to 9.5 and −500 mV.

The results obtained are as shown below.

| Sample | |
|---|---|
| 1 | 34 emu/g |
| 2 | 28 |
| 3 | 30 |
| 4 | 36 |
| 5 | 32 |
| (average value | 34.0) |

Example 8

Example 5 was repeated except that the pH and the oxidation-reduction potential in Example 5 were changed to 9.0 and −350 mV.

The results obtained are as shown below.

| Sample | |
|---|---|
| 1 | 30 emu/g |
| 2 | 27 |
| 3 | 29 |
| 4 | 23 |
| 5 | 28 |
| (average value | 27.4) |

Example 9

Example 5 was repeated except that the polystyrene particulates in Example 5 were changed to $TiO_2$ particulates (the same in as Example 1).

The average value of 5 samples obtained is as follows.

Average value: 10.0 emu/g.

Example 10

Example 6 was repeated except that the polystyrene particulates in Example 6 were changed to glass cut fibers (the same as in Example 4).

The average value of 5 samples obtained is as follows.

Average value: 23.1 emu/g.

Example 11

Example 5 was repeated except that the rate of $Fe^{2+}$ supplied was changed to 30 and 60 ml/min.

The average values of 5 samples obtained are as follows.

| | 30 ml/min. | 60 ml/min. |
|---|---|---|
| Average value: | 32.5 emu/g | 36.3 emu/g |

Example 12

Example 5 was repeated except that the rates of $Fe^{2+}$ and $NO_2-$ supplied were changed to 60 ml/min of $Fe^{2+}$ and 3 or 5 ml/min. of $NO_2-$.

The average values of 5 samples obtained are as follows:

| $NO_2^-$ | 3 ml/min. | 5 ml/min. |
|---|---|---|
| Average value: | 25.4 emu/g | 12.2 emu/g |

Example 13

Example 5 was repeated except that the pH in Example 5 was changed to pH 7.5 on initiation, and pH 9.5 on completion.

The results obtained are as follows.

| Sample | |
|---|---|
| 1 | 33 emu/g |
| 2 | 32 |
| 3 | 28 |
| 4 | 34 |
| 5 | 33 |
| (Average value | 32.0) |

Comparative Example 1

Example 5 was repeated except that the pH in Example 5 was changed to 5.5.

The results obtained are as shown below. No stable ferrite coatings could be formed.

| Sample | |
|---|---|
| 1 | no ferrite coating possible |
| 2 | 10 emu/g |
| 3 | 5 |
| 4 | no ferrite coating possible |
| 5 | 15 |

Comparative Example 2

Example 5 was repeated except that the pH in Example 5 was changed to 11.5.

The results obtained are as shown below.

| Sample | |
|---|---|
| 1 | 2 emu/g |
| 2 | 15 |
| 3 | 5 |
| 4 | 6 |
| 5 | no ferrite coating possible |

Comparative Example 3

Example 5 was repeated except that the pH and the oxidation-reduction potential in Example 5 were changed to pH 6.5 and an oxidation-reduction potential of −550 mV.

Much by-products were formed, and no coating was possible.

Comparative Example 4

Example 5 was repeated except that the pH in Example 5 was changed to 6.5 and no control of oxidation-reduction potential was done.

The results obtained are as shown below, and the coatings greatly deviated in saturated magnetization amount.

| Sample | |
|---|---|
| 1 | 28 emu/g |
| 2 | 10 |
| 3 | 21 |
| 4 | 5 |
| 5 | 18 |
| (Average value | 16.4) |

As shown in Examples 5 to 13, it has been rendered possible to control the saturated magnetization amount by controlling pH and oxidation-reduction potential.

What is claimed is:

1. A method for forming a ferrite coating on a substrate, which comprises:

(a) bring the substrate into contact with water or an aqueous solution and, (b) adding a ferrous ion solution, an oxidizer solution and a pH controller while controlling dropwise addition rate of the ferrous ion solution or the oxidizer solution so that pH and an oxidation-reduction potential will be included within the range specified by A (6, −440 mV), B (6, −130 mV), C (11, −430 mV) and D (11, −740mV) in a pH - oxidation-reduction potential graph which is FIG. 1 to give a ferrite coating having a saturated magnetization of 1 to 60 emu/g.

2. A method as claimed in claim 1, wherein pH of the aqueous solution is 6.5 to 10.

3. A method as claimed in claim 1, wherein said contact is carried out at 60° to 90° C.

4. A method as claimed in claim 1, wherein the pH-oxidation-reduction potential is subjected to fixed point control.

5. A method as claimed in claim 1, wherein said ferrous ion solution contains at least one of ferrous chloride, ferrous sulfate or ferrous acetate.

6. A method as claimed in claim 1, wherein said substrate is a particulate and/or fibrous substrate.

7. A method as claimed in claim 6, wherein said particulate or fibrous substrate has a mean diameter of 100 μm or less.

8. A method as claimed in claim 6, wherein said particulate is a resin, a metal, a metal oxide, an organic pigment, a cellulose or a ceramic.

9. A method as claimed in claim 6, wherein said fibrous substrate is glass cut fibers.

10. A method as claimed in claim 1, wherein said oxidizer is a nitrite.

11. A method as claimed in claim 1, wherein said aqueous solution contains at least one transition metal species selected from zinc, cobalt, nickel, manganese, copper, vanadium, antimony, lithium, molybdenum, titanium, rubidium, magnesium, aluminum, silicon, chromium, tin, calcium, cadmium or indium.

12. A method as claimed in claim 1, wherein an addition ratio of an oxidizer solution to that of a ferrous ion solution (an oxidizer solution/a ferrous ion solution ) is 0.016 to 1.

* * * * *